US005713069A

United States Patent [19]

Kato

[11] Patent Number: 5,713,069

[45] Date of Patent: Jan. 27, 1998

[54] INDUCTION HEAT FIXING APPARATUS WITH PREHEATING GUIDE

[75] Inventor: Takeshi Kato, Toyokawa, Japan

[73] Assignee: Minolta Co., Ltd., Osaka, Japan

[21] Appl. No.: 753,613

[22] Filed: Nov. 27, 1996

[30] Foreign Application Priority Data

Nov. 30, 1995 [JP] Japan ..... 7-312846

[51] Int. Cl.[6] ..... G03G 15/20

[52] U.S. Cl. ..... 399/330; 219/619

[58] Field of Search ..... 399/328, 330, 399/331, 400; 219/216, 619, 645, 643, 644, 469; 432/60

[56] References Cited

U.S. PATENT DOCUMENTS

| | | | |
|---|---|---|---|
| 4,472,616 | 9/1984 | Maurice et al. . | |
| 4,570,044 | 2/1986 | Kobayashi et al. | 219/619 |
| 5,278,618 | 1/1994 | Mitani et al. | 399/329 |
| 5,392,401 | 2/1995 | Schiel | 100/93 RP |
| 5,506,666 | 4/1996 | Masuda et al. | 399/335 |
| 5,526,103 | 6/1996 | Kato et al. | 399/328 |
| 5,552,582 | 9/1996 | Abe et al. | 219/619 |
| 5,568,235 | 10/1996 | Amarakoon | 399/319 |
| 5,568,240 | 10/1996 | Ohtsuka | 399/335 |

FOREIGN PATENT DOCUMENTS 54-39645 3/1979 Japan .

*Primary Examiner*—Robert Beatty

*Attorney, Agent, or Firm*—McDermott, Will & Emery

[57] ABSTRACT

The present invention relates to an induction heat fixing apparatus for heating a transporting medium containing: a system for generating an induction heat by using an induction current; a pressure member disposed in pressing contact with the induction heat generating system at a contact portion; and a preheating member positioned at upstream side of the contact portion with respect to the transporting direction of the medium, whereby the preheating member is heated by the induction current generated by the induction heat generating system. One object of present invention is to prepare an induction heat fixing apparatus which is compact and has high efficient heating.

20 Claims, 3 Drawing Sheets

INDUCTION HEAT FIXING APPARATUS WITH PREHEATING GUIDE

BACKGROUND OF THE INVENTION

1. Field of the Invention

The present invention relates to a fixing apparatus used in image forming apparatuses such as electrophotographic copying machines, printers and facsimile machines and more particularly, to a fixing apparatus that utilizes induction heating to fix a toner image to a sheet.

2. Description of the Related Art

In recent years, in order to increase the value of products including electrophotographic copying machines, the coexistence of reduced energy consumption (lower power consumption) in fixing apparatuses and improved operability for users (quick prints) in addition to more compact designs has come to attract more and more attention as an important topic.

An induction heat type fixing apparatus that uses high-frequency induction as the heat source has been proposed as an apparatus to satisfy the requirements as stated. This induction heat fixing apparatus is arranged with a concentric coil inside a hollow fixing roller which is comprised by a metal conductor. A high-frequency current flows through the coil resulting in a high-frequency magnetic field that causes an induction eddy current to occur in the fixing roller with the skin resistance of the fixing roller body causing joule heat generation to occur in the fixing roller itself. Because the coil can be arranged inside the fixing roller in this manner, the fixing apparatus can be made compact in addition to greatly improving the electricity-to-heat conversion efficiency thereby making it possible to reduce the warm-up time.

However, even though the above-mentioned induction heat type fixing apparatus has a favorable heat generating efficiency, because the only heatable region on the sheet to be transported where the toner image was formed is the nip portion which is formed between the fixing roller and the pressure roller, the fixing roller had to be maintained at quite a high temperature in order to concentrate and generate heat. Therefore, not only was wasteful time required to warm up the apparatus but there were also problems including the temperature inside apparatuses such as an electrophotographic copying machines increasing that adversely affected other portions.

in particular, the temperature around the coil increased greatly due to the heat generated by the coil itself arranged inside the fixing roller used for generating the magnetic flux as well as the heat irradiation toward the inner surface of said fixing roller. Therefore, it was necessary to use a material with excellent heat-resisting properties at high temperatures as the material for peripheral portions which thereby increased the cost.

SUMMARY OF THE INVENTION

The object of the present invention is to provide an induction heat fixing apparatus that eliminates the above-mentioned problems.

Another object of the present invention is to provide a compact induction heat fixing apparatus.

A further object of the present invention is to provide an induction heat fixing apparatus that has efficient heating.

A further object of the present invention is to provide an induction heat fixing apparatus that does not impede compactness while achieving a lower fixing temperature by means of efficient heating.

The objectives of the present invention are solved by means of an induction heat fixing apparatus comprised by a heat generating member that generates heat by means of an induction current, a pressure member disposed in pressing contact with said heat generating member and an induction coil that generates a magnetic flux supplied to said heat generating member. The induction heat fixing apparatus fixes a toner image formed on a sheet to be transported toward the contact portion between said heat generating member and said pressure member to the sheet. The induction heat fixing apparatus is characterized by a pre-heating member positioned at the upstream side of the contact portion in the sheet transporting direction that generates heat by means of an induction current induced by said induction coil to preheat a sheet to be fed into the contact portion.

The present invention will be described in more detail below with reference to the figures and embodiments.

DESCRIPTION OF THE PREFERRED EMBODIMENTS

A preferred embodiment of the present invention is characterized by an induction heat fixing apparatus comprised by a heat generating member that generates heat by means of an induction current, a pressure member disposed in pressing contact with said heat generating member and an induction coil that generates a magnetic flux supplied to said heat generating member. The induction heat fixing apparatus fixes a toner image formed on a sheet to be transported toward the contact portion between said heat generating member and said pressure member to the sheet. The induction heat fixing apparatus is further characterized by a pre-heating member positioned at the upstream side of the contact portion in the sheet transporting direction that generates heat by means of an induction current induced by said induction coil to preheat a sheet to be fed into the contact portion.

It is possible to carry out pre-heating with a compact construction by the pre-heating member generating heat simultaneously with the heat generating member by means of the induction coil without separately providing a new heat generating source. Therefore, because the heating time of the toner on the sheet becomes longer, the fixing temperature can be lowered eliminating wasteful heat dissipation to carry out efficient heat generation thereby reducing the warm-up time even more in addition to obtaining an image with favorable fixing properties. Moreover, by lowering the fixing temperature, the heat-resisting properties of the peripheral portions need not be set more than necessary,. and therefore the cost of parts can be greatly reduced. Even further, in order to dynamically utilize the leakage flux of the magnetic flux generated by the induction coil, it is absorbed into the pre-heating member, and therefore electromagnetic radiation noise radiating toward the outer peripheral portions is reduced.

In the induction heat fixing apparatus, it is further preferable for the pre-heating member to be a metal plate having a width wider than the width of the sheet in a direction perpendicular to the sheet transporting direction.

When constructed in this manner, the sheet can be uniformly preheated over its entire surface using an extremely small space.

In the induction heat fixing apparatus, it is even further preferable for the region facing the sheet to be transported at the pre-heating member to be a black color.

When constructed in this manner, the heat transfer from the pre-heating member to the sheet is carried out even more efficiently.

The embodiments of this invention will be described below with reference to the accompanying drawings.

<First Embodiment>

Figure 1:
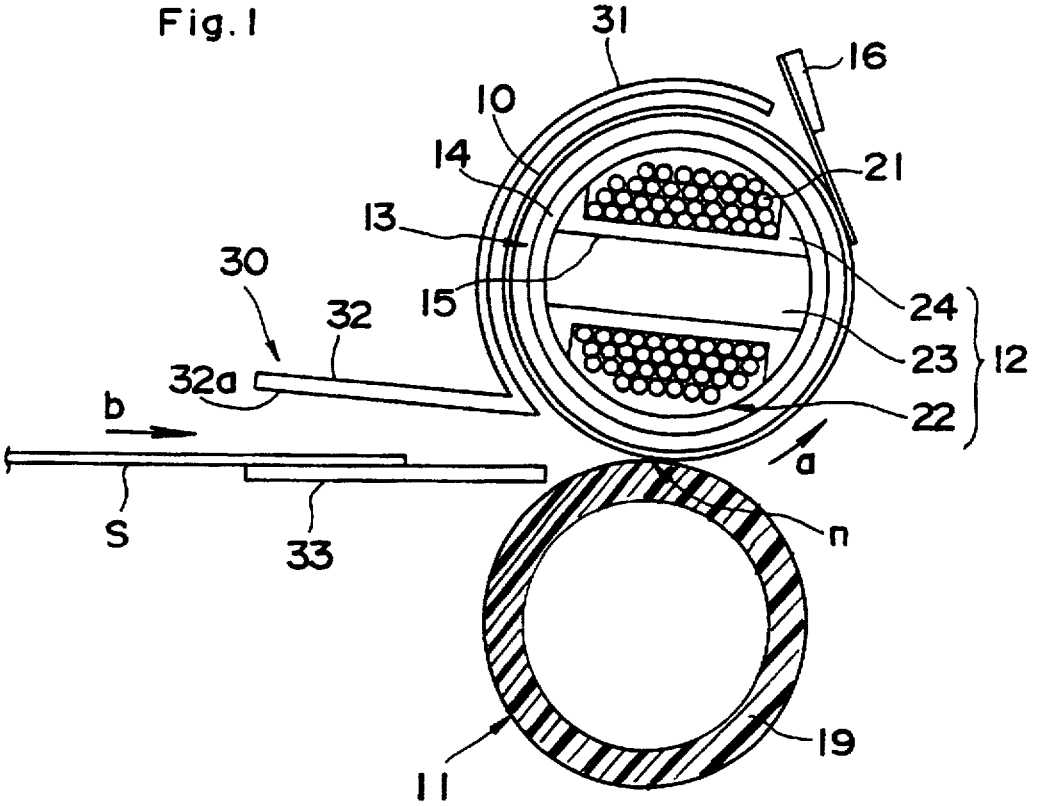
FIG. 1 is a cross-section showing an outline of the induction heat fixing apparatus related to a first embodiment of the present invention.
Figure 2:
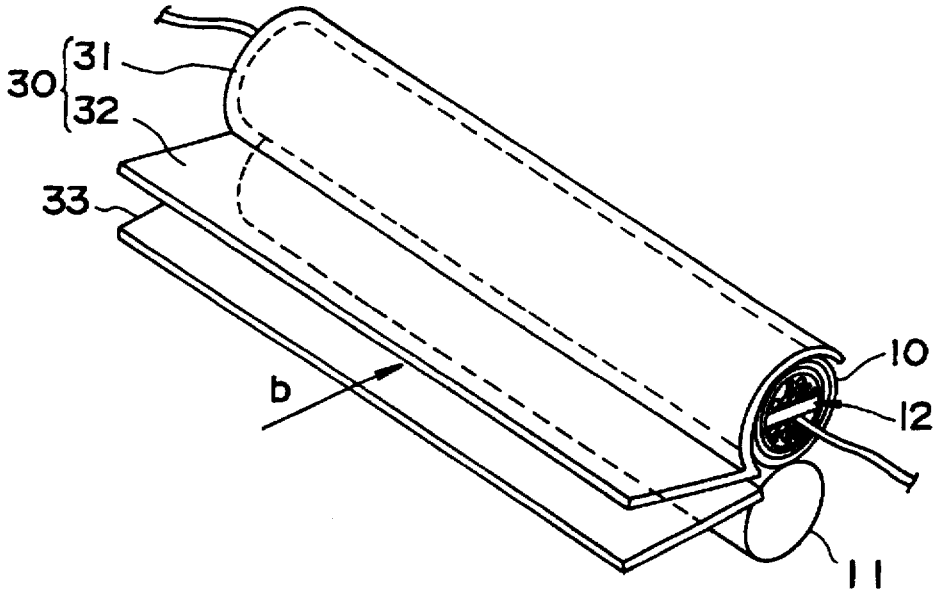
FIG. 2 is an outside view of the induction heat fixing apparatus related to the first embodiment.
Figure 3:
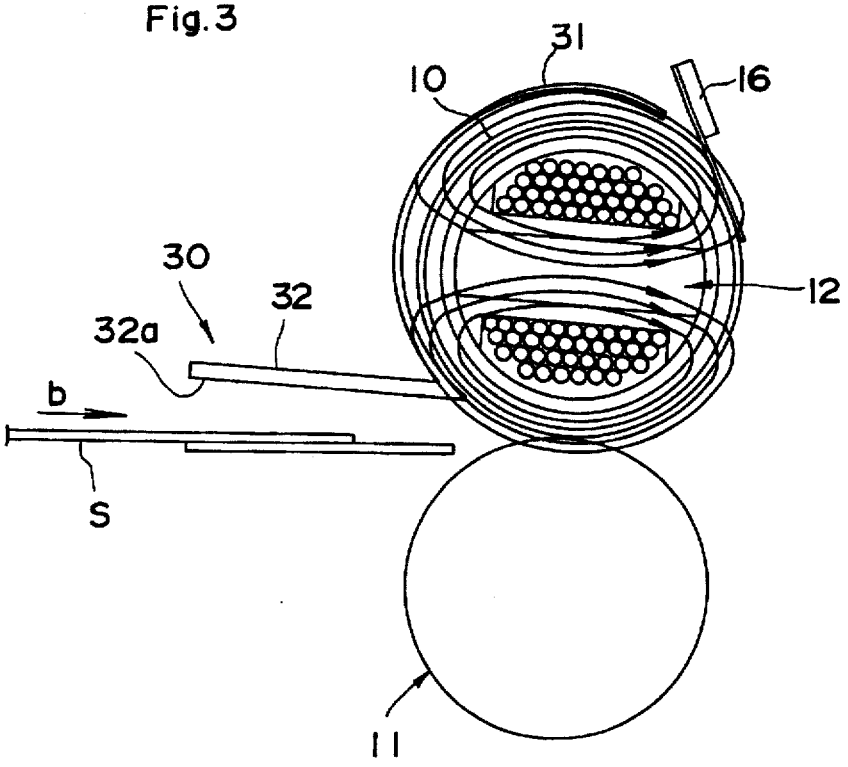
FIG. 3 is a view to explain the pre-heating theory of the induction heat fixing apparatus related to the first embodiment.

FIG. 1 is a cross-section showing an outline of the induction heat fixing apparatus related to the first embodiment of the present invention. FIG. 2 is an outside view of the induction heat fixing apparatus related to the first embodiment. FIG. 3 is a view to explain the pre-heating theory of the induction heat fixing apparatus related to the first embodiment.

As shown in FIG. 1, the induction heat fixing apparatus incorporated into a printer or other device has a fixing roller 10 provided as the heat generating member that can be driven to rotate in the direction of arrow "a" and a pressure roller 11 provided as the pressure member arranged making contact with said fixing roller 10 and is driven to rotate along with the rotation of the fixing roller 10.

The fixing roller 10 is a hollow electrically conductive pipe and inside the roller is arranged a coil assembly 12 that generates an induction current (eddy current) in the fixing roller 10.

The coil assembly 12 has a core 23 comprised by a magnetic material, a bobbin 24 in which is formed a through-hole 15 for inserting the core 23 and an induction coil 22 formed by coiling copper wire 21 a number of times in one direction around the bobbin 24. Hereupon, the core 23 is arranged at a right angle to the copper wire 21 of the induction coil 22 to form a magnetic path. For the coil 22, it is preferable to use a single or Litz copper wire having a fixed layer and insulation layer on the surface. The core 23 is comprised by a magnetic material, for example, ferrite core or lamination layer core. Further, the bobbin 24 functions as an insulation portion providing insulation between the core 23 and the induction coil 22.

This coil assembly 12 is housed inside a holder 14 that is formed separately from the bobbin 24 in two portions such that it is not exposed to the exterior portions. In this way, the coil assembly 12 is retained such that it is surrounded entirely by the holder 14 with the entire structure constituting a holder unit 13.

The fixing roller 10 has bearings formed on both of its ends and is mounted to a fixing unit frame (not shown in figure) to freely rotate. Furthermore, the fixing roller 10 has a drive gear (not shown in figure) fixed to one side and is driven to rotate by means of a drive source (not shown in figure) such as a motor connected to this drive gear. Moreover, the holder 14 is fixed to the fixing unit frame and does not rotate and is housed inside the roller 10 separated from the inner peripheral surface of the fixing roller 10 at a predetermined gap.

A toner support member onto which is transferred the toner image not yet fixed, or more precisely, a sheet S is fed from the left direction as indicated by arrow b in the figure and sent toward the nip portion n that functions as the contact portion between the fixing roller 10 and the pressure roller 11. While the heat of the heated fixing roller 10 and the pressure exerted from both rollers 10, 11 are being applied to the sheet S, the sheet S is fed through the nip portion n. By means of this action, the final fixing of the toner not yet fixed is carried out and a fixed toner image is formed on the sheet S. The sheet S that passed through the nip portion n naturally separates from the fixing roller 10 by means of the curvature of the fixing roller 10 or is forcibly separated from the fixing roller 10 by means of a separation claw (not shown in figure) provided such that the leading edge portion of the claw scrapes against the surface of the fixing roller 10. The sheet is then fed in a direction to the right in the figure. This sheet S is then fed by a paper delivery roller (not shown in figure) and delivered onto a paper delivery tray.

A temperature sensor 16 that detects the temperature of the fixing roller 10 is provided approximately above the fixing roller 10. This temperature sensor 16 presses against the surface of the fixing roller 10. The temperature sensor 16 is comprised by, for example, a thermistor and, while the temperature of the fixing roller 10 is detected by this thermistor 16, the temperature of the fixing roller 10 is kept at an optimum temperature by controlling the flow of electricity to the induction coil 22.

A thermostat (not shown in figure) is further provided approximately above the fixing roller 10 as a safety mechanism for cases when the temperature rises abnormally. This thermostat presses against the surface of the fixing roller 10 and if the temperature reaches a previously set value, the contacts of the thermostat open to cutoff the flow of electricity to the induction coil 22. This prevents the fixing roller 10 from reaching higher temperatures than a fixed temperature.

A silicon rubber layer 19 that is a surface separation heat resistant rubber layer is formed around the periphery of a shaft core of the pressure roller 11. Further, the holder 14 is formed from a heat resistant insulating engineering plastic and the bearings and separation claw are formed from a heat resistant slidable engineering plastic and other material.

The fixing roller 10 is formed from a metal material such as iron, stainless steel alloy tube, nickel, carbon steel tube or an aluminum alloy tube. The outer peripheral surface of the roller is coated with a fluororesin and a heat resistant separation layer is formed on the surface.

In this embodiment, it is further preferable for the fixing roller 10 to be formed from a nonmagnetic stainless steel such as SUS304 or a material with a comparatively low specific magnetic permeability such as nickel. The reason for this is that, although a magnetic material is normally used when an eddy current is induced in the fixing roller 10 by means of the induction coil 22 to heat the roller, when considered from the viewpoint of the speed of the temperature rise of the fixing roller 10, there is not always a guarantee that a magnetic material will provide favorable results and, even if nonmagnetic stainless steel, nickel or other similar material is used, sufficient induction heating of the fixing roller 10 is allowed. The present invention dynamically and effectively utilizes the leakage flux occurring due to the above-mentioned type of material used for the fixing roller 10.

In addition, as shown in FIG. 1 and FIG. 2, in this embodiment in particular, a pre-heating member 30 is provided at the upstream side (left side in figure) of the sheet transporting direction at the nip portion n that is between the fixing roller 10 and the pressure roller 11. This pre-heating member 30 has a width wider than the width of the sheet in a direction perpendicular to the transporting direction of the sheet and, as shown in FIG. 3, is comprised by a metal plate (for example iron or SUS430). By subjecting this metal plate to flux leakage from the magnetic flux generated by the induction coil 22 provided inside the fixing roller 10 which leaks to the exterior portions, it generates heat through an eddy current loss and a hysteresis loss in like manner to the fixing roller 10. Thereby allowing uniform pre-heating of the entire surface of the sheet S by utilizing a very small space.

Hereupon, if the pre-heating member 30 is a material with strong magnetic properties (for example, a material with an iron base or an electrogalvanized copper plate (SECC) or similar material), almost all the magnetic flux is absorbed thereby allowing reductions in the leakage to the exterior portions as well as preventing the components inside the apparatus from being effected. In addition to this, the apparatus can be efficiently used without the magnetic flux leaking. Because of this, the above-mentioned materials are more preferable.

The pre-heating member 30 is comprised by a circular arc-shaped portion 31 separated from the surface area of the fixing roller 10 by only a predetermined distance arranged to cover one portion of the roller, and a plate portion 32 that is arranged next to the circular arc-shaped portion 31 and is separated by only a predetermined distance above the sheet S that is transported onto a lower guide plate 33. The circular arc-shaped portion 31 is arranged to cover the fixing roller 10 as widely as possible and by setting the distance between the surface of the fixing roller 10 and itself as small as possible, the distance from the area where the induction magnetic flux generates is shortened. In addition to this, the quantity of heat of the heat generating portion can be made smaller allowing the temperature to rise faster.

The plate portion 32 of the pre-heating member 30 is mainly heatedly means of heat conduction from the circular arc-shaped portion 31 that generates heat itself. Further, to improve the heat transfer efficiency to the sheet S even more, it is preferable for the lower surface 32*a* which is a part of the plate portion 32 and is the area opposite to the sheet S to be transported to be a black color which has favorable irradiation rate. This black color is, for example, applied by a paint. Moreover, the pre-heating member 30 is heated to a temperature that causes the toner to soften, for instance 100° C. to 130° C. This temperature can be set to an optimum temperature depending on the material, thickness and other factors of the metal plate that comprises the pre-heating member 30.

If the pre-heating member 30 is arranged in the above-mentioned manner and a high-frequency current is passed through the induction coil 22, magnetic flux is generated as shown in FIG. 3 and an induction current occurs in the fixing roller 10 generating heat. In addition to this, one portion of the magnetic flux generated by means of the induction coil 22 leaks to the exterior portion of the fixing roller 10 and in a like manner, the circular arc-shaped portion 31 of the pre-heating member 30 that is subjected to this leakage flux generates an induction current and generates heat. This heat is conducted to the plate portion 32 to preheat the sheet S that is fed into the nip portion n. Under this type of pre-heating state, the sheet S on which is formed the toner image is transported from the left direction as shown by arrow b in the figure and by means of the heat of the fixing roller 10 and the pressure exerted from both rollers 10, 11 being applied, the toner that has not been fixed is fixed and a fixing toner image is formed on the sheet S in the final stage.

In this manner, according to the present embodiment, the induction coil 12 that heats the fixing roller 10 and the pre-heating member 30 that is heated by being subjected to the leakage flux generated from the induction coil are provided wherein, the pre-heating member 30 is heated simultaneously with the fixing roller 10 making it possible to carry out pre-heating with a compact construction without separately providing a new heat source.

Therefore, because not only is the nip portion n heated by the fixing roller 10 but also the heating time of the toner on the sheet becomes longer thereby making it possible to lower the fixing temperature and eliminate wasteful heat dissipation to carry out efficient heating thereby reducing the warm-up time even more in addition to obtaining an image with favorable fixing properties. Moreover, by lowering the fixing temperature, because the heat-resisting properties of the peripheral portions need not be set more than necessary, the cost of parts can be greatly reduced.

Furthermore, because the leakage flux of the magnetic flux generated by the induction coil 12 is dynamically utilized, electromagnetic radiation noise radiating toward the exterior portions of the fixing roller 10 can be reduced.

<Second Embodiment>

Figure 4:
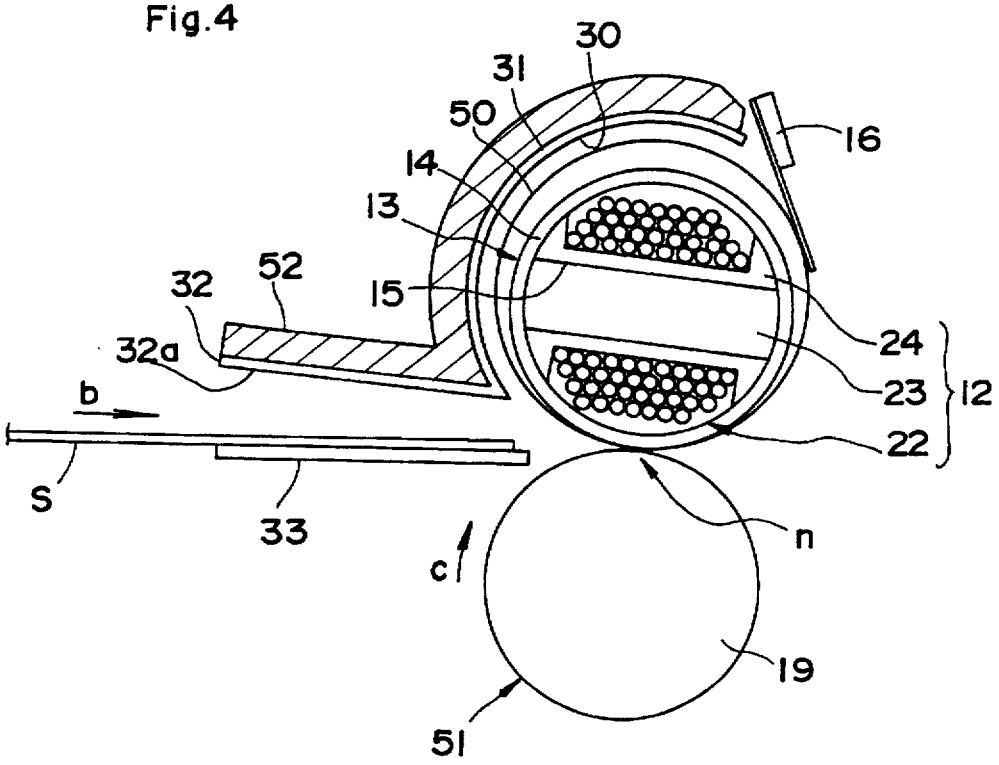
FIG. 4 is a cross-section showing an outline of the induction heat fixing apparatus related to a second embodiment of the present invention.

FIG. 4 is a cross-section showing an outline of the induction heat fixing apparatus related to the second embodiment of the present invention. Symbols and numbers used for members identical to those of the first embodiment have their descriptions omitted.

The second embodiment differs from the first embodiment by the fact that a thin metal sleeve 50 having flexibility is used as the heating member in place of the fixing roller 10 of the first embodiment.

As shown in FIG. 4, this induction heat fixing apparatus is comprised by a non-rotating holder unit 13 fixed to a fixing unit free, a pressure roller 51 disposed to be rotable in the direction of arrow c pressing against the holder unit 13, and the metal sleeve 50 that is held between said pressure roller 51 and holder unit 13 and is driven to rotate along with the rotation of the pressure roller 51.

The metal sleeve 50 is formed from an electrically conductive magnetic member such as nickel. The outer peripheral surface of this member is coated with a fluororesin and a heat resistant separation layer is formed on the surface. The thickness of the metal sleeve 50 is from 20 μm to 60 μm.

A coil assembly 12 that generates an induction current (eddy current) in the metal sleeve 50 is arranged inside the metal sleeve 50. The coil assembly is retained by a holder 14.

Because the holder unit 13 presses against the inner peripheral surface of the metal sleeve 50 in a fixing apparatus that utilizes the metal sleeve 50, the holder 14 must be formed at a certain thickness (for example, 1 mm or more for a resin) in order to ensure a mechanical strength that can resist the pressure between itself and the pressure roller 51. In contrast to this, for a construction in which the metal sleeve 50 and the holder 14 make contact at the nip portion and slide relative to each other, there is no need to maintain clearance between the fixing roller 10 and the holder 14 during assembly from the viewpoint of ensuring a smooth rotation.

With regard to the plate portion 32 of the preheating member 30, as shown in FIG. 4, the lower surface 32*a* of the plate portion 32 is a black color to improve the heat transfer efficiency to the sheet S in like manner to the first embodiment and, in addition to this, a heat-resistant member 52 such as a silicone babbled rubber with a low heat conduction rate and a small heat capacity is arranged on the surface opposite to the lower surface along the entire pre-heating member 30. This allows the generated heat to be transferred to the sheet S without any wasteful loss.

According to the second embodiment as well, results like the first embodiment can be achieved. Moreover, the above-mentioned type of heat-resistant member 52 can naturally be installed in the device of the first embodiment also.

<Third Embodiment>

Figure 5:
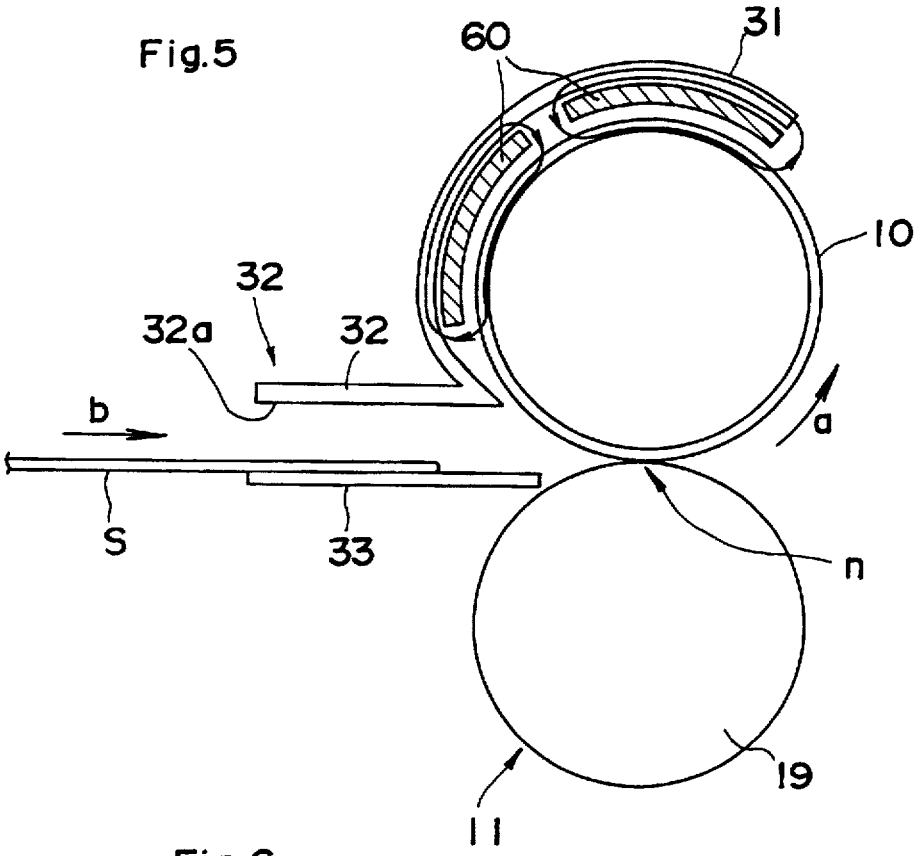
FIG. 5 is a cross-section showing an outline of the induction heat fixing apparatus related to a third embodiment of the present invention along with the generated magnetic flux.
Figure 6:
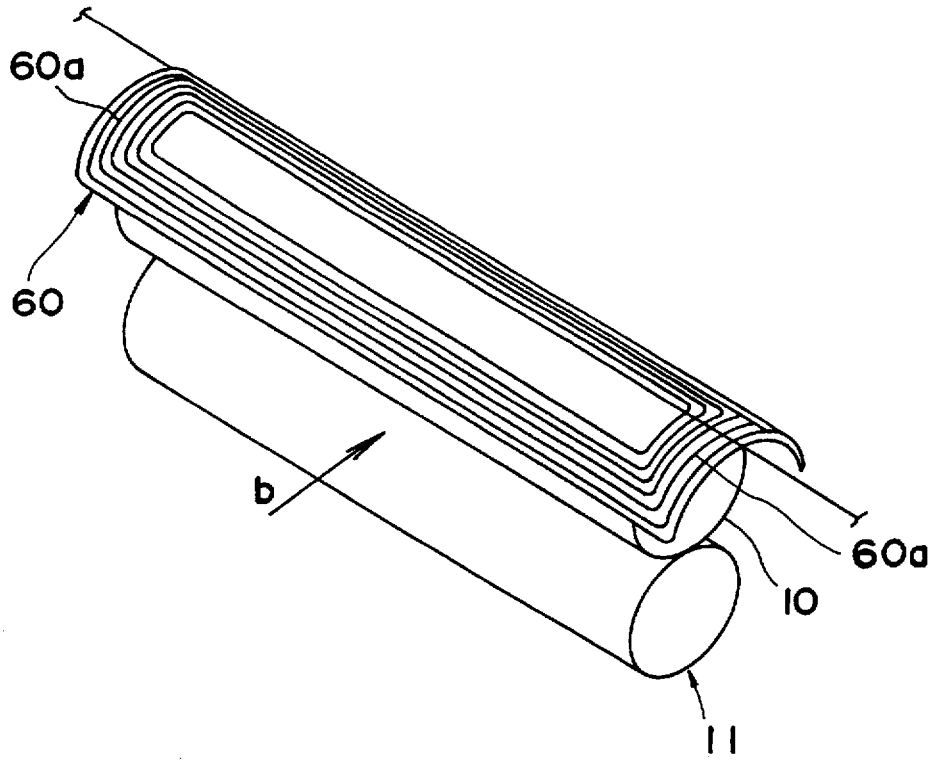
FIG. 6 is an outside view showing the coil arrangement of the induction heat fixing apparatus related to the third embodiment.

FIG. 5 is a cross-section showing an outline of the induction heat fixing apparatus related to the third embodiment of the present invention along with the generated magnetic flux and FIG. 6 is an outside view showing the coil arrangement of the induction heat fixing apparatus related to the third embodiment. Symbols and numbers used for members identical to the first embodiment have their descriptions omitted.

The third embodiment differs from the first embodiment by the fact that an induction coil 60 provided on the exterior portion of the fixing roller 10 is used in place of the coil assembly 12 of the first embodiment. This induction coil 60 has a flat shape that forms a circular arc along the outer surface of the fixing roller 10 and is arranged at a predetermined distance from the surface of the fixing roller 10. Conversely, the circular arc-shaped portion 31 of the preheating member 30 is arranged on the outer side of the induction coil 60 such that using for example, a heat-resistant insulating member, it covers the induction coil 60.

As shown in FIG. 5, because the induction coil 60 is provided on the exterior portion of the fixing roller 10, in like manner to the fixing roller 10, an induction current is directly induced by the magnetic flux generated by means of the induction coil 60 to heat the circular arc-shaped portion 31 of the pre-heating member 30. Therefore, because the leakage flux from the inside of the fixing roller 10 is not used in the third embodiment, a material with, for example, strong magnetic properties can be used as the material of the fixing roller 10.

According to the third embodiment as well, results like the first embodiment can be achieved. Moreover, as shown in FIG. 6, it is preferable for the portion 60*a* that forms the component in the peripheral direction of the induction coil 60 to be arranged such that it protrudes outward in the axial direction of the fixing roller 10 to make the temperature distribution in the axial direction of the fixing roller 10 uniform.

The following results were obtained according to the present invention as described above. Because the preheating member is provided at the upstream side of the contact portion in the sheet transporting direction that generates heat by means of an induction current induced by the induction coil to preheat the sheet to be fed into the contact portion, it is possible to carry out pre-heating with a compact construction without separately providing a new heat source.

Therefore, because the heating time of the toner on the sheet becomes longer, it is possible to lower the fixing temperature and eliminate wasteful heat dissipation for efficient heating. This allows the warm-up time to be reduced even more in addition to obtaining an image with favorable fixing properties. Moreover, by lowering the fixing temperature, because the heat-resisting properties of the peripheral portions need not be set more than necessary, the cost of parts can be greatly reduced.

Furthermore, when dynamically utilizing the leakage flux of the magnetic flux generated by the induction coil, electromagnetic radiation noise radiating toward the outer peripheral portions is reduced due to its being absorbed into the pre-heating member.

Even further, in the above-mentioned induction heat fixing apparatus, it is preferable for the pre-heating member to be a metal plate having a width wider than the width of the sheet in a direction perpendicular to the sheet transporting direction.

When constructed in this manner, the sheet can be uniformly preheated over its entire surface using an extremely small space.

Even further, in the above-mentioned induction heat fixing apparatus, it is preferable for the region facing the sheet to be transported of the pre-heating member to be a black color.

When constructed in this manner, because the region facing the sheet to be transported of the pre-heating member is a black color, the heat transfer from the pre-heating member to the sheet is carried out even more efficiently.

While this invention has been described to deepen the reader's understanding of it, it is not limited thereto. Rather, this invention is limited only insofar as defined by the above-mentioned description and all equivalents thereof.

What is claimed is:

1. An induction heat fixing apparatus for heating a transporting medium comprising:

means for generating an induction heat by using an induction current;

a pressure member disposed in pressing contact with the induction heat generating means at a contact portion; and a preheating member positioned at upstream side of the contact portion with respect to the transporting direction of the medium, said preheating member heated by the induction current generated by the induction heat generating means.

2. The induction heat fixing apparatus of claim 1 wherein the induction heat generating means comprises:

a heat member formed by an electrically conductive member and having a hollow space in its interior;

core within the heat roller;

coil provided around the core; and means for passing an alternating current through the coil.

3. The induction heat fixing apparatus of claim 1 wherein the preheating member has a length longer than that of the transporting medium along a direction perpendicular to the transporting direction of the medium.

4. The induction heat fixing apparatus of claim 1 wherein the preheating member has the inner surface which is confronted to the medium, said inner surface being colored by black.

5. The induction heat fixing apparatus of claim 2 further comprises a heat sensing means which senses the surface of the heat member and controls the alternating current.

6. The induction heat fixing apparatus of claim 5 further comprises a breaker which shuts down the alternating current when the heat sensing means senses a predetermined value.

7. The induction heat fixing apparatus of claim 1 wherein the surface of the pressure member is formed by silicone rubber.

8. The induction heat fixing apparatus of claim 2 wherein the surface of the heat member is formed by nonmagnetic material.

9. The induction heat fixing apparatus of claim 1 wherein the preheating member is formed by ferromagnetic material.

10. The induction heat fixing apparatus of claim 2 wherein the preheating member is formed along the surface of the heat member within a predetermined distance.

11. The induction heat fixing apparatus of claim 10 wherein the preheating member has a first portion which is formed along the surface of the heat member within a predetermined distance and a second portion which extends to an upstream side of the first portion with respect to the transporting direction of the medium.

12. The induction heat fixing apparatus of claim 1 wherein the preheating member has a heat insulator which is disposed on the outer surface of the preheating member.

13. The induction heat fixing apparatus of claim 12 wherein the heat insulator is silicone rubber.

14. An induction heat fixing apparatus for heating a transporting medium comprising:

means for generating an induction heat by using an induction current;

a rotating sleeve covering the induction heat generating means;

a pressure member disposed in pressing contact with the surface of the sleeve at a contact portion; and a preheating member positioned at upstream side of the contact portion with respect to the transporting direction of the medium, said preheating member heated by the induction current generated by the induction heat generating means.

15. The induction heat fixing apparatus of claim 14 wherein the induction heat generating means comprises:

a heat member formed by an electrically conductive member and having a hollow space in its interior;

core within the heat roller;

coil provided around the core; and means for passing an alternating current through the coil.

16. The induction heat fixing apparatus of claim 14 wherein the sleeve has an electrical conductivity and a magnetic character.

17. The induction heat fixing apparatus of claim 16 wherein the sleeve has a fluoride coated outer surface.

18. The induction heat fixing apparatus of claim 14 wherein the preheating member has a heat insulator which is disposed on the outer surface of the preheating member.

19. An induction heat fixing apparatus for heating a transporting medium comprising:

a rotating heat member formed by an electrically conductive member;

means for generating an induction heat by using an induction current, said generating means being confronted to the outer surface for the rotating heat member;

a pressure member disposed in pressing contact with the surface of the sleeve at a contact portion; and a preheating member positioned at upstream side of the contact portion with respect to the transporting direction of the medium, said preheating member heated by the induction current generated by the induction heat generating means.

20. The induction heat fixing apparatus of claim 19 wherein the preheating member is formed along the surface of the heat member within a predetermined distance.

* * * * *